US005619096A

United States Patent [19]

Kaliszewski et al.

[11] Patent Number: 5,619,096

[45] Date of Patent: Apr. 8, 1997

[54] PRECOATED FLUORESCENT LAMP FOR DEFECT ELIMINATION

[75] Inventors: Mary S. Kaliszewski, Cleveland Heights; William E. Ishler, Lyndhurst, both of Ohio

[73] Assignee: General Electric Company, Schenectady, N.Y.

[21] Appl. No.: 378,763

[22] Filed: Jan. 26, 1995

Related U.S. Application Data

[63] Continuation of Ser. No. 996,988, Dec. 28, 1992, abandoned.

[51] Int. Cl.[6] ..... H01J 63/04; H01J 1/62

[52] U.S. Cl. ..... 313/489; 313/635

[58] Field of Search ..... 313/485, 487, 313/489, 492, 493, 635

[56] References Cited

U.S. PATENT DOCUMENTS

| | | | |
|---|---|---|---|
| 3,967,153 | 6/1976 | Milke et al. | 313/489 |
| 3,995,192 | 11/1976 | Hammer | 313/489 |
| 4,020,385 | 4/1977 | Lagos | 313/489 |
| 4,079,288 | 3/1978 | Maloney et al. | 313/489 |
| 4,289,991 | 9/1981 | Schreurs | 313/492 |
| 4,293,594 | 10/1981 | Yoldas et al. | 427/107 |
| 4,363,998 | 12/1982 | Graff et al. | 313/487 |
| 4,379,981 | 4/1983 | Rusch | 313/489 |
| 4,639,637 | 1/1987 | Taubner et al. | 313/489 |
| 4,751,426 | 6/1988 | Hoffman et al. | 313/487 |
| 4,857,798 | 8/1989 | Ford | 313/487 |
| 5,045,752 | 9/1991 | Jansma | 313/487 |
| 5,258,689 | 11/1993 | Jansma et al. | 313/489 |

*Primary Examiner*—Sandra L. O'Shea
*Assistant Examiner*—Vip Patel
*Attorney, Agent, or Firm*—Stanley C. Corwin

[57] ABSTRACT

A protective layer or precoat of a metal oxide for an internal conductive layer in a rapid-start fluorescent lamp is formed of yttria, ceria or silica to suppress the occurrence of localized appearance defects referred to as measles. The protective layer may be used in combination with conductive layers having a uniformly flat profile or a U-shaped bathtub profile to further enhance the suppression of measle defects. The lamp retains the desirable qualities of good startability and energy efficiency while at the same time avoiding the undesirable measle appearance defects.

11 Claims, 1 Drawing Sheet

PRECOATED FLUORESCENT LAMP FOR DEFECT ELIMINATION

This application is a continuation of application Ser. No. 07/996,988, filed Dec. 28, 1992, now abandoned.

BACKGROUND OF THE INVENTION

1. Field of the Invention

This invention relates to the elimination or reduction of appearance defects known as "measles", as defined hereinafter, in fluorescent lamps having a conductive starting aid layer or coating on the inner surface of the lamp tube or glass envelope.

2. Background of the Invention

Rapid-start or similar fluorescent lamps including an internal conductive layer, such as a tin oxide or indium oxide layer, and mercury vapor as part of the discharge sustaining gas fill are subject to the formation of localized appearance defects referred to as "measles." Such defects comprise a dark spot surrounded by a concentric ring of discoloration usually on the order of one or two millimeters in diameter. Measles are believed to develop during lamp operation as a result of an interaction involving the conductive layer and the mercury in arc discharge. The mercury is presumed to penetrate the phosphor layer or coating leading to conditions which allow build-up of charge and subsequent discharge which results in the measle defect by disrupting the phosphor layer and generally forming a small crater in the glass tube.

The occurrence of such appearance defects has been delayed in fluorescent lamps having a tin oxide conductive layer by varying the electrical resistance of the conductive layer along the axial length of the glass tube. More particularly, the electrical resistance profile of the conductive layer has been varied from a flat or constant value to a U-shaped or "bathtub" profile wherein a relatively low resistance value is provided at the center portion of the lamp and relatively high resistance values are provided at the end portions of the lamp. The bathtub resistance profile is difficult to control and to uniformly maintain in a commercially acceptable manner using existing production equipment and technology. The relative differences in electrical resistance along the axial length of the lamps achieved in this manner tend to decrease after about the first 500 hours of lamp operation. Moreover, the resulting variations in electrical resistance merely delay the occurrence of such defects from a time following the first 1000 hours of lamp operation to a later time after about 3000 to 4000 hours of lamp operation. This is a rather short improvement in the total life of the lamp life which is in the order of about 20,000 hours. Accordingly, this process technique does not provide a satisfactory solution to such measle defects.

A variety of protective or barrier layers are known in the art for inhibiting or delaying other appearance defects characterized by darkened stains or a general discoloration of the phosphor layer and/or conductive layer. U.S. Pat. No. 3,624,444 discloses the use of a protective layer over a tin oxide conductive layer in a low pressure mercury vapor discharge lamp to inhibit black stains formed on the inner side of the glass tube. The protective layer is formed of oxides of elements of the secondary groups in columns 4 and 5 of the periodic table of elements, preferably titanium dioxide and zirconium dioxide. In U.S. Pat. No. 4,338,544, an aluminum oxide protective or barrier coating is taught to inhibit a "blackening" phenomenon on the tin oxide coating attributed to its reaction with mercury. U.S. Pat. No. 3,967,153 discloses a fluorescent lamp having an alumina layer deposited by application of a suspension of aluminum oxide over the tin or indium oxide conductive coating, with a layer of phosphor covering the alumina. U.S. Pat. No. 4,338,544 discloses a similar protective coating in a fluorescent lamp which further comprises an inert gas, such as krypton, neon or xenon, used together with mercury as the gas fill in the lamp. U.S. Pat. No. 4,363,998 likewise discloses the use of an alumina coating applied over the tin oxide coating, but also comprises the use of antimony oxide mixed with the alumina, the antimony oxide acting to improve the performance of a zinc silicate phosphor applied over the alumina-antimony oxide layer.

Thus it is known in the art to employ a layer of alumina, or certain other metal oxides, as a protective layer or precoat over the layer of conductive material to prevent its discoloration and/or that of the subsequently applied phosphor materials. However, such precoats of metal oxides have not effectively prevented or reduced the occurrence of measle defects.

SUMMARY OF THE INVENTION

The present invention provides an improved fluorescent lamp having a protective layer or precoat comprising a particulate coating over a layer of conductive material, wherein the protective layer comprises ceria, yttria, silica or combinations thereof. The protective layer effectively prevents or reduces the occurrence of measles. These improvements are substantially maintained throughout the life of the fluorescent lamp with a lesser occurrence of measle defects irrespective of whether the resistance profile is flat or bathtub. Conductive layers presently known for use in fluorescent lamps include oxides of tin and indium.

The protective layer may be used in combination with a bathtub electrical resistance profile to further enhance the improvements in suppression of measle defects. In such combinations, the improvements attributed to the bathtub profile itself are better maintained during the life of the fluorescent lamp.

Presently, ceria and yttria are preferred metal oxides since they have been found to substantially suppress the occurrence of measles with or without the benefit of the bathtub resistance profile.

A wide range of particle sizes may be used. Preferably, the particle is small enough to enable the formation of a particle suspension or dispersion in a fluid medium of a colloidal system for deposition onto a surface such as the internal conductive layer of the fluorescent lamp tube. Herein, such a particle is referred to as a colloidal particle. The presently preferred particle sizes have a major dimension in the range from about one nanometer to about 500 nanometers, and, more preferably in the range of from about one to about 100 nanometers, and, most preferably in the range of from one to about 50 nanometers or less. The protective layer may be applied directly to the conductive layer using conventional application techniques. Preferred application techniques involve deposition from a colloidal system wherein the particle is suspended or dispersed in an aqueous liquid medium.

BRIEF DESCRIPTION OF THE DRAWING

The drawing illustrates, in perspective view, a partially broken away section of a low pressure mercury discharge fluorescent lamp in accordance with the present invention.

DETAILED DESCRIPTION

Figure 1:
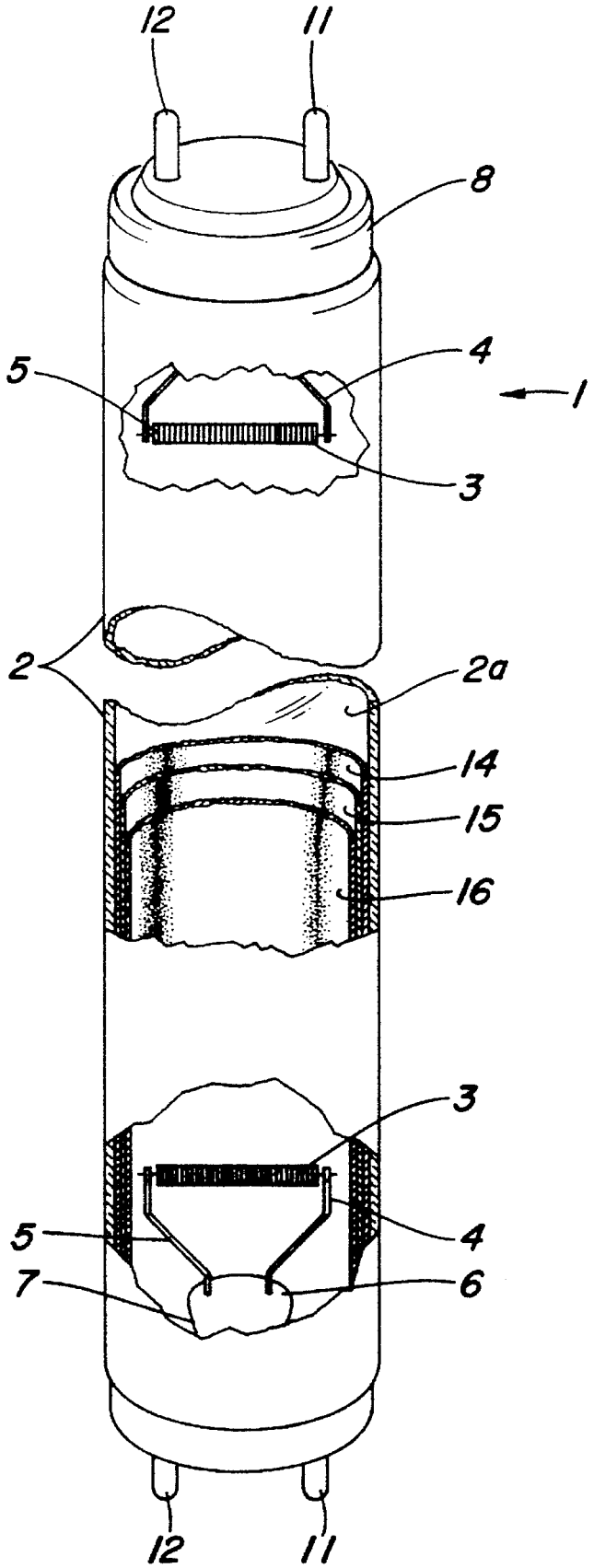

Referring to the drawing, fluorescent lamp 1 comprises an elongate sealed glass envelope or tube 2 having an inner wall surface 2*a*, and having electrodes 3 at each end. The envelope 2 contains the known discharge sustaining fill comprising mercury and an inert, ionizable gas (not shown). Electrodes 3 are connected to lead wires 4 and 5 which extend through a glass seal 6 in a mount stem 7 to the electrical contacts of base 8 fixed at both ends of the sealed glass envelope and containing contact pins 11 and 12 which are electrically connected to leads 4 and 5. The inert gas will generally be argon or a mixture of argon and krypton and/or neon at a low pressure generally less than 5 or 10 torr. The inert gas acts as a buffer or means for limiting the arc current.

The inner wall surface 2*a* is covered by a conductive layer or coating 14 which is a starting aid for the lamp 1. The conductive layer 14 is covered by a protective layer or precoat 15 which is preferably a continuous coating in order to adequately protect the conductive layer. The protective layer or precoat 15 is in turn covered by a phosphor layer or coating 16. These layers are described in greater detail below.

The conductive layer 14 is preferably tin oxide, but may be formed of indium oxide or other electrically conductive materials known in the art to aid rapid starting and energy efficiency. The thickness of layer 14 may vary some along the axial length of the tube, but is generally uniform within the known technological capabilities for applying such coatings to the inner wall of glass tubes for fluorescent lamps. The thickness of the layer 14 is sufficient to provide the preselected parameters of startability and wattage consumption efficiency of the lamp.

The protective layer 15 is a colloidal metal oxide which provides superior protection against measle defect formation as compared with known materials. As indicated above, the colloidal metal oxide forming the protective layer 15 comprises at least one oxide selected from the group consisting essentially of ceria, yttria, silica or a combination of these metal oxides. In a preferred embodiment, the metal oxide will be selected from the group consisting essentially of ceria, yttria or mixtures thereof. The thickness of layer 15 is within the range of thicknesses used commonly for alumina, e.g. corresponding with a bulb loading of from 20–60 mg of oxide per 48" lamp of 1 or 1.5" diameter, and is sufficient to allow only minimal defect formation in the lamp. In terms of weight per unit area, the protective layer 15 may be applied in an amount ranging from about 100 to about 750 $mg/m^2$, and more preferably from about 125 to about 625 $mg/m^2$.

The protective layer 15 is covered with phosphor layer 16 comprising at least one phosphor material. Any phosphor known in the fluorescent lamp art is suitable for use with the present invention. The phosphor may be applied in one or more layers, and may comprise more than one phosphor as well as known phosphor performance enhancers.

The coatings of the present invention may be applied by methods known in the art. Known methods for applying coatings to the inner wall 2*a* of envelopes 2 for fluorescent lamps include dipping in a liquid based colloidal dispersion, spraying, and by electrostatic methods. The thickness of each layer 14, 15, 16 may vary slightly over the axial length of the tube, but it is generally uniform within the known technological capabilities for applying such coatings. Each layer is applied to the full axial length of the tube.

One means of applying layer 14 of conductive material is by spraying a solution of a tin oxide precursor onto the inner envelope wall surface. To that end, a spray head is inserted a small distance into one end of the tube, and from this position the entire axial length of the tube is coated with the conductive material. As a result of inherent limitations in using such spraying procedure, the conductive material layer 14 is generally slightly thicker at the end of the tube into which the spray head was inserted than at other portions of the tube.

The protective layer 15 is applied by any of the known methods which can be sufficiently controlled to allow application over the conductive layer 14. Such methods include dipping, spraying, and application by electrostatic means. Preferred processes comprise flowing an aqueous colloidal suspension or dispersion of the particulate forming the layer or coating to be applied through the tube in a "down-flush" or an "up-flush" flow technique. This colloidal dispersion or suspension may be custom made, or may be obtained commercially, e.g. from Nyacol Products, Inc., Ashland, Mass., under the tradename "NYACOL". The quantity of colloidal metal oxide layer 15 applied is preferably sufficient to achieve a continuous coating, as opposed to a discontinuous coating, in order to provide adequate protection and will generally be substantially the same as that of known compounds for protective coatings, e.g., alumina.

The phosphor layer 16 may be applied over the layer 15 by any of the known methods of applying such materials. The phosphor material may be any such material known in the art.

Upon completion of the application of layers 14, 15 and 16, the manufacture of the lamp 1 continues in a known conventional manner. The invention is further illustrated in the following non-limitative example.

EXAMPLE

The following experimental protocol was designed to follow closely the standard, conventional practices in the art of fluorescent lamp production. In a standard one inch diameter, four foot long glass tube used in the manufacture of fluorescent lamps, a layer of conductive tin oxide was deposited by the standard spraying method. Next, covering this layer, a layer of colloidal metal oxide particles was applied by the down-flush process over the first layer. The colloidal metal oxides used in this example are shown in the Table below. The colloidal metal oxide was applied at an approximate weight of 20–60 mg/bulb. Following the metal oxide layer, a layer of phosphor material was applied over the protective layer. The glass tube was then subjected to further conventional manufacturing processes used in production of fluorescent lamps. The lamps thus produced were tested by operating at standard conditions for the indicated time periods, with the results shown in the Table. As indicated, control lamps having an alumina protective layer and comparative lamps having a zirconia protective layer were included in the tests.

TABLE

| Precoat Material | Particle Size (nm) | Resistance Profile | Burn Time | Measles Rating |
|---|---|---|---|---|
| alumina | 50–100 | flat | 3000 hr | <5 |
| alumina | 50–100 | bathtub | 5000 hr | 5 |
| yttria | 10 | flat | 5000 hr | 8 |
| yttria | 10 | bathtub | 5000 hr | 10 |
| ceria | 10 | flat | 3000 hr | 10 |
| silica | 50 | flat | 3000 hr | 5 |
| silica | 50 | bathtub | 3000 hr | 9 |

TABLE-continued

| Precoat Material | Particle Size (nm) | Resistance Profile | Burn Time | Measles Rating |
|---|---|---|---|---|
| silica | 20 | flat | 3000 hr | 5 |
| silica | 20 | bathtub | 3000 hr | 9 |
| zirconia | 50 | flat | 3000 hr | <5 |
| zirconia | 50 | bathtub | 3000 hr | <5 |

The "measles rating" ranges from 1 to 10, and it is based on a subjective evaluation of the population of the "measles" defects. A rating of 5 or lower is unacceptable, while a rating of 10 indicates no measles formation at all, for the indicated test period. A rating of at least 8 is desired to make the lamp commercially acceptable.

The resistance profile, shown in the Table, refers to the variation in electrical resistance of the conductive tin oxide layer along the axial length of the lamp, and has been referred to as either "flat" or "bathtub" in the art. The flat resistance profile has no substantial variation in electrical resistance along the axial length of the lamp. In the bathtub profile, each of the end portions (e.g. axially outboard 12 inch lengths in a four foot long bulb) of the lamp has a much higher resistance than that of the center portion of the lamp. The bathtub profile is more resistant to measles formation than is the flat profile, but the bathtub is much more difficult to achieve in production.

As shown by the test results, ceria, yttria and silica provide improved measle ratings as compared with alumina and zirconia. In addition, these metal oxides may be used in combination with a bathtub electrical resistance profile to further enhance the improvements in suppression of measle defects.

What is claimed is:

1. A fluorescent lamp substantially lacking measles defects which are characterized by a dark spot surrounded by a concentric ring of discoloration of about 1 to 2 mm in diameter comprising a sealed glass envelope having an inner wall and containing an arc-sustaining fill, said envelope having a conductive layer on said inner wall and at least one phosphor layer, and a means of inhibiting formation of measles defects, said defect inhibiting means being disposed between said conductive layer and said at least one phosphor layer, and said defect inhibiting means comprising a protective layer of at least one metal oxide selected from the group consisting essentially of yttria, ceria and mixtures thereof and having a uniform median particle size of greater than zero to less than or equal to 50 nm.

2. A fluorescent lamp as in claim 1, wherein said protective layer uniformly covers said conductive layer.

3. A fluorescent lamp as in claim 1, wherein said protective layer has a weight in the range of from about 100 to about 750 mg/m2.

4. A fluorescent lamp as in claim 1, wherein said protective layer has a weight in the range of from about 125 to about 625 mg/m2.

5. A fluorescent lamp as in claim 1, wherein said conductive layer has a bathtub shape electrical resistance profile.

6. A fluorescent lamp as in claim 1, wherein said conductive layer has a bathtub shape electrical resistance profile and said conductive layer comprises a layer of tin oxide.

7. A fluorescent lamp as in claim 1 wherein said fluorescent lamp is substantially free of measles defects after 3,000 hours of burn time.

8. A fluorescent lamp comprising a glass envelope having inner walls and enclosing electrodes, a discharge sustaining gas fill including mercury, a conductive layer deposited upon the inner walls, a protective layer of metal oxide, and at least one phosphor layer, said protective layer being deposited between said conductive layer and said phosphor layer as a means of inhibiting electrical charge build up on mercury fill which has penetrated said phosphor layer, and being selected from the group consisting essentially of yttria, ceria, and combinations thereof and having a uniform median particle size of greater than zero to less than or equal to about 50 nm.

9. A fluorescent lamp as in claim 8, wherein said protective layer has a weight in the range of from 100 to about 750 $mg/m^2$.

10. A fluorescent lamp as in claim 9, wherein said conductive layer has a bathtub shape electrical resistance profile.

11. A fluorescent lamp as in claim 10, wherein said metal oxide is selected from the group consisting essentially of yttria and ceria.

* * * * *